US006749082B1

(12) United States Patent
Nickel

(10) Patent No.: US 6,749,082 B1
(45) Date of Patent: Jun. 15, 2004

(54) CUP HOLDER AND NAPKIN

(75) Inventor: Gregory L. Nickel, Seattle, WA (US)

(73) Assignee: Nickel Drumworks USA, Inc, Seattle, WA (US)

( * ) Notice: Subject to any disclaimer, the term of this patent is extended or adjusted under 35 U.S.C. 154(b) by 0 days.

(21) Appl. No.: 10/323,172

(22) Filed: Dec. 18, 2002

(51) Int. Cl.[7] ..... B65D 3/22
(52) U.S. Cl. ..... 220/738; 220/739; 229/403
(58) Field of Search ..... 220/738, 739; 229/403; 215/395

(56) References Cited

U.S. PATENT DOCUMENTS 5,174,965 A * 12/1992 Jones et al. ..... 422/102
5,205,473 A 4/1993 Coffin, Sr.
5,425,497 A 6/1995 Sorensen
6,047,852 A * 4/2000 Evans et al. ..... 220/793
6,308,859 B1 * 10/2001 Johnson ..... 220/756
6,349,846 B1 * 2/2002 Meza ..... 220/739
6,667,010 B2 * 12/2003 Kuchar ..... 422/104

* cited by examiner

*Primary Examiner*—Joseph Man Moy
(74) *Attorney, Agent, or Firm*—Cook, Alex, McFarron, Manzo, Cummings & Mehler, Ltd.

(57) ABSTRACT

A holder and napkin assembly for a beverage or liquid food cup. The holder is defined by a sleeve mounted on and encircling a beverage cup or liquid food cup. The sleeve has an open top and an open bottom through which the cup extends and an inner surface adjacent the cup. The napkin includes a generally rectangular body portion and a smaller generally rectangular tab portion connected by a line of weakness. The tab portion is adhered to the holder, preferably on the inner surface of the holder. The line of weakness is positioned at the top edge of the holder sleeve. The napkin body and napkin tab are notched on opposite sides at the line of weakness. The inner surface of the holder has a plurality of discreet, spaced apart, hemispherical-shaped protrusions on the inner surface thereof.

5 Claims, 1 Drawing Sheet

Fig. 1.
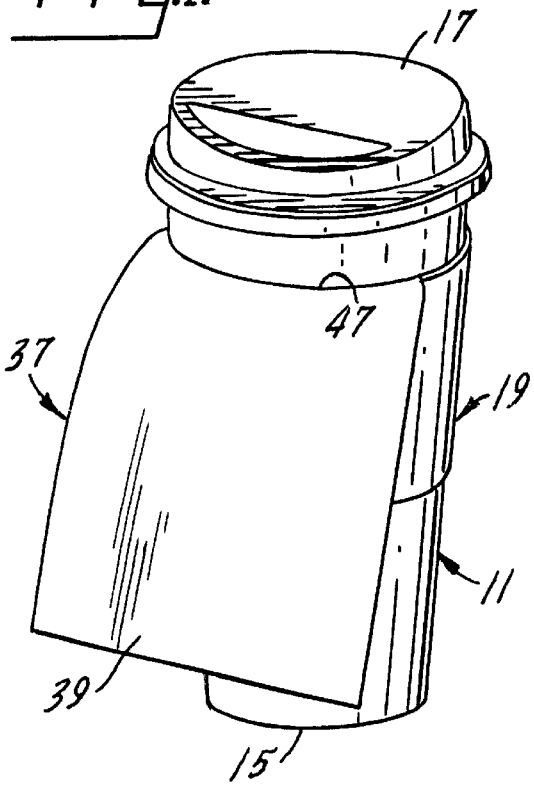
Fig. 2.
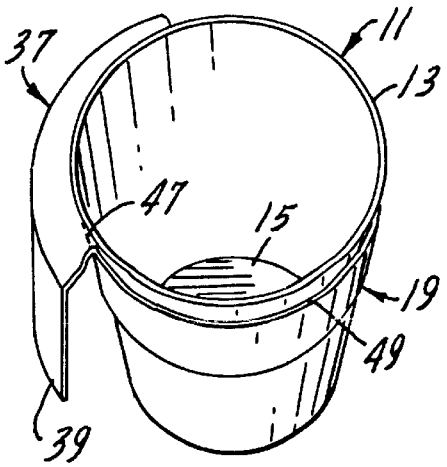
Fig. 4.
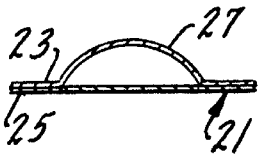
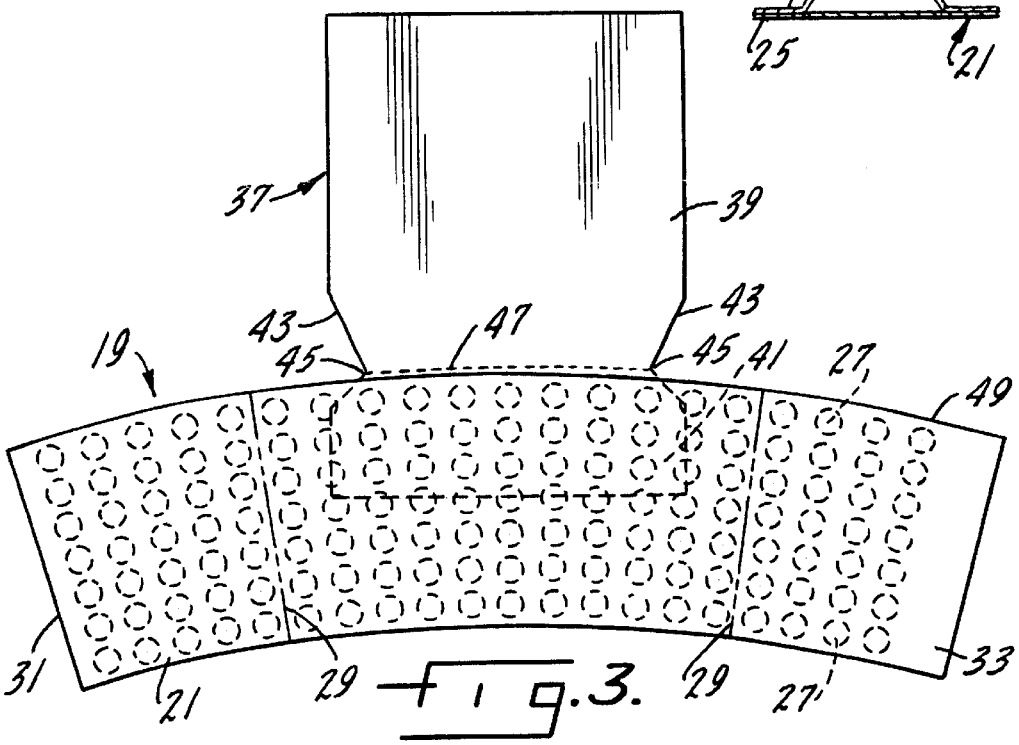
Fig. 3.

CUP HOLDER AND NAPKIN

BACKGROUND OF THE INVENTION

This invention is directed to disposable cups used to dispense hot and cold beverages and liquid foods such as soups, etc. For environmental reasons, beverage retailers such as fast food establishments and coffee shops have switched from the use of insulated plastic disposable beverage cups to disposable cups made of biogradeable cellulosic materials such as paper. There are drawbacks to the use of paper cups because paper provides little in the way of insulation qualities at least in the thickness of the paper used in such disposable cups. To overcome this problem, cup holders with better insulation qualities have been developed to fit over the disposable paper beverage and liquid food cups to provide adequate insulation for comfortable handling by a consumer. Examples of such paper holders can be found in U.S. Pat. Nos. 5,205,473 and 5,425,497.

SUMMARY OF THE INVENTION

This invention is directed to a paper holder for a disposable beverage and liquid food cup which paper holder also carries a detachable napkin. It is particularly adaptable to a paper cup holder which is stored in a flat configuration and is then opened to a sleeve-like configuration to fit over a tapered disposable beverage and liquid food cup.

An object of this invention is a cup holder having an attached napkin.

Another object of this invention is a cup holder having an attached napkin that is securely fastened to the cup holder, but may be readily detached for use by the consumer.

Still another object of this invention is napkin which improves the gripability of the cup holder.

Yet another object of this invention is a cup holder having an attached napkin which also functions as a bib to protect the user against spills or overflows of the fluid in the cup.

An additional object of this invention is to provide a napkin which is securely held to a cup holder, but can be easily detached.

Yet an additional object of this invention is a napkin attached to a cup holder which napkin can carry an advertisement to be seen by the user.

Other objects may be found in the following specification, claims, and drawings.

BRIEF DESCRIPTION OF THE DRAWINGS

The invention is illustrated more or less diagrammatically in the following drawings wherein:

FIG. 1 is a isometric view of a disposal beverage or liquid food container with a holder made in accordance with the teachings of this invention;

FIG. 2 is an isometric view of an empty beverage or liquid food cup with a cap removed and showing the holder and attached napkin of this invention;

FIG. 3 is a plan view of the napkin of this invention attached to a strip of material used to form a cup holder; and FIG. 4 is an enlarged partial cross section view of a insulating protrusion of the cup holder.

DESCRIPTION OF THE PREFERRED EMBODIMENT

A disposal beverage or liquid food cup 11 is shown in FIGS. 1 and 2 of the drawings. The cup is preferably formed of paper and has a wider top portion at its rim 13 and a smaller diameter bottom wall 15. While the beverage cup 11 described is made of paper or other cellulosic material, it may also be made of any suitable plastic. Its cover 17 shown in FIG. 1 is usually made of plastic.

As is conventional, a sleeve like holder 19, usually made of a cellulosic material such as paper, fits over the cup 11 which is tapered from its bottom wall 15 upwardly to its rim 13. As shown best in FIGS. 3 and 4 of the drawings, the holder is formed from a strip 21 of paper having an inner layer 23 and an outer layer 25. The inner layer is formed with hemis-spherical protrusions 27 covering essentially the entire inner layer 23 to provide insulation qualities for the strip 21 by trapping air within the protrusions when the inner layer is glued to the outer layer. Fold lines 29 are formed in the inner and outer layers 23 and 25 to enable the strip to be stored flat after the opposite ends 31 and 33 are glued together in a conventional manner to form a sleeve.

FIG. 3 shows the napkin 37 having a body portion 39 and a tab portion 41 which are formed integrally. Triangular notches 43 cut on opposite sides of the napkin formed peaks 45 aligned with a line of weakness such as perforations 47 extending between the peaks of the notches to enable the body portion 39 of the napkin to fold over the outer layer 25 of the holder 19 and the outer surface of the beverage cup 11. The perforations 47 of the napkin 37 align with the top edge 49 of the cup holder 19 so that the napkin is readily accessible to the user for use as a bib and where it can easily be removed by tearing along the line of perforations 47 to as a napkin. The napkin tab portion 41 may be adhered to the inner surface of the inner the holder strip 21 as shown in FIG. 3 or it may be inserted between the inner and outer layers 23 and 25 and there adhered. Another option is to adhere the tab 41 to the outer surface of the outer layer 25.

It should be apparent that instructions or advertisements may be placed on the body portion 39 of the napkin 37 where they will be visible to a user.

I claim:

1. A holder and napkin assembly for a beverage or liquid food cup, said assembly including:

said holder defined by a sleeve mounted on and encircling a beverage or liquid food cup, said sleeve having an open top and an open bottom through which the cup extends and an inner surface intermediately adjacent said cup, said napkin including a generally rectangular body portion and a smaller generally rectangular tab portion connected by a line of weakness, said tab portion adhered to said holder with said body portion positioned over said front surface of said holder.

2. The holder and napkin assembly of claim 1 in which said tab portion is adhered to said inner surface of said holder.

3. The holder and napkin assembly of claim 1 in which said line of weakness is positioned at the top edge of said holder sleeve.

4. The holder and napkin assembly of claim 1 in which said napkin body and napkin tab are notched on opposite sides thereof at said line of weakness.

5. The holder and napkin assembly of claim 1 in which said inner surface of said holder includes a plurality of discreet, spaced apart, approximately hemispherical-shaped protrusions forming air pockets distributed over substantially the entire inner surface thereof when said inner and outer layers are glued to each other.

* * * * *